US007617805B2

(12) United States Patent
Highum

(10) Patent No.: US 7,617,805 B2
(45) Date of Patent: Nov. 17, 2009

(54) CYLINDER LINER AND METHOD CONSTRUCTION THEREOF

(75) Inventor: Eric Highum, Howell, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 32 days.

(21) Appl. No.: 11/766,898

(22) Filed: Jun. 22, 2007

(65) Prior Publication Data

US 2008/0314353 A1 Dec. 25, 2008

(51) Int. Cl.
*F02F 1/00* (2006.01)
*F02F 1/10* (2006.01)

(52) U.S. Cl. ..... 123/41.84; 123/193.2; 29/888.061

(58) Field of Classification Search ..... 123/41.84, 123/193.2; 29/888.061
See application file for complete search history.

(56) References Cited

U.S. PATENT DOCUMENTS 1,853,562 A 4/1932 Herr
3,472,160 A * 10/1969 Scott ..... 100/176
4,447,275 A 5/1984 Hiraoka et al.
6,732,699 B2 5/2004 Wakade et al.
7,162,798 B2 * 1/2007 Westra ..... 29/888.061

FOREIGN PATENT DOCUMENTS

| | | | |
|---|---|---|---|
| DE | 19638596 | A1 * | 3/1998 |
| JP | 56065926 | | 6/1981 |
| JP | 59133974 | A * | 8/1984 |
| JP | 3149339 | | 6/1991 |
| JP | 586966 | | 4/1993 |
| JP | 2001200751 | | 7/2001 |
| KR | 20070060326 | | 6/2007 |

* cited by examiner

*Primary Examiner*—Noah Kamen
(74) *Attorney, Agent, or Firm*—Robert L. Stearns; Dickinson Wright PLLC

(57) ABSTRACT

A cylinder liner for receipt in an internal combustion engine cylinder block having a water cooling jacket surrounding a portion of the cylinder liner and method of construction thereof. The cylinder liner has a wall with an inner surface providing a cylinder bore extending along a central axis for reciprocation of a piston against an axial portion thereof and an outer surface opposite the axial portion. The outer surface has a hardened outer layer of purely martensitic microstructure for direct exposure to fluid in the water cooling jacket.

8 Claims, 2 Drawing Sheets

CYLINDER LINER AND METHOD CONSTRUCTION THEREOF

BACKGROUND OF THE INVENTION

1. Technical Field

This invention relates generally to internal combustion engines, and more particularly to cylinder liners for diesel engines.

2. Related Art

It is known to cool cylinder liners with water in a water-cooling jacket extending about a portion of an outer surface of the cylinder liner. Unfortunately, the outer surface portion of the cylinder liner that comes in contact with the cooling water typically exhibits erosion from cavitation. The cavitation results from localized pressure variations brought on by vibration transmitted throughout the cylinder liner. As a result of these changes in pressure, the formation and disappearance of bubbles (known as cavitation) imparts mechanical forces in the form of shocks to the outer surface of the cylinder liner, which in turn, results in erosion of the cylinder liner outer wall. As expected, the cavitation, and thus, erosion, is typically most severe in regions of greatest vibration, which generally coincides with a region of the cylinder liner wall through which a piston reciprocates.

In an attempt to combat the onset of cavitation erosion, layers of plating have been formed on the outer surface of the cylinder liner, such as chromium, or ceramic layers have been used. However, these attempts are encumbered with increased costs brought on by both relatively expensive materials and inefficient manufacturing processes. Other attempts have incorporated an outer layer of white cast iron, with an underlying layer of martensitic and sorbitic microstructure, followed by the underlying parent material.

A cylinder liner manufactured according to the present invention overcomes or greatly minimizes any limitations of the prior art described above, and provides cylinder liners that can operate in heavy duty applications, while reducing their propensity for cavitation erosion, and thus, improving their useful life, all at a reduced overall cost.

SUMMARY OF THE INVENTION

A cast iron cylinder liner for an internal combustion engine manufactured in accordance with one presently preferred aspect of the invention reduces the potential for cavitation erosion of an outer surface of the liner at a minimal cost in manufacture, thereby providing an economically feasible way to increase the useful life of the cylinder liner between servicing. The cast iron cylinder liner has a wall providing a bore extending along a central axis for reciprocation of a piston therein and an outer surface shaped for receipt in a cylinder block. At least a portion of the outer surface opposite the portion of the bore through which the piston reciprocates is exposed to a cooling jacket in the cylinder block to reduce the operating temperature of the cylinder liner and piston. The portion of the outer surface exposed to the cooling jacket has a purely martensitic microstructure forming a hardened layer of a predetermined thickness to inhibit cavitation erosion of the outer surface.

Another aspect of the invention includes providing the martensitic hardened layer with a depth of about 10 percent or less of a thickness of the wall of the cylinder liner.

Yet another aspect of the invention includes a method of constructing a cylinder liner. The method includes casting a cylinder liner body having a cylinder wall and rough machining an inner surface of a cylinder bore and an outer surface of the cylinder wall. Then, finish machining at least a portion of the outer surface which will be exposed to water within a cooling jacket of a cylinder block. Then, heat treating the finish machined outer surface to provide a hardened layer of purely martensitic microstructure. And, if required, the method can also include hardening the cylinder bore. Then, tempering the hardened surfaces, if necessary. Lastly, finish machining the cylinder bore and a cylinder flange, along with any sealing areas, as necessary.

Accordingly, cylinder liners produced in accordance with the invention are useful for inhibiting the formation of cavitation erosion on an outer surface thereof. In addition, the cylinder liners are economical in manufacture, in assembly, and in use. Accordingly, the total cost to implement a mechanism to reduce the onset of cavitation erosion to the cylinder liner, and to increase the useful life of the cylinder liner, is reduced.

BRIEF DESCRIPTION OF THE DRAWINGS

These and other aspects, features and advantages provided by cylinder liners manufactured in accordance with the invention will become readily apparent to those skilled in the art in view of the following detailed description of the presently preferred embodiments and best mode, appended claims, and accompanying drawings, wherein like reference numerals are used to identify like features, in which:

DETAILED DESCRIPTION OF PREFERRED EMBODIMENTS

Figure 1:
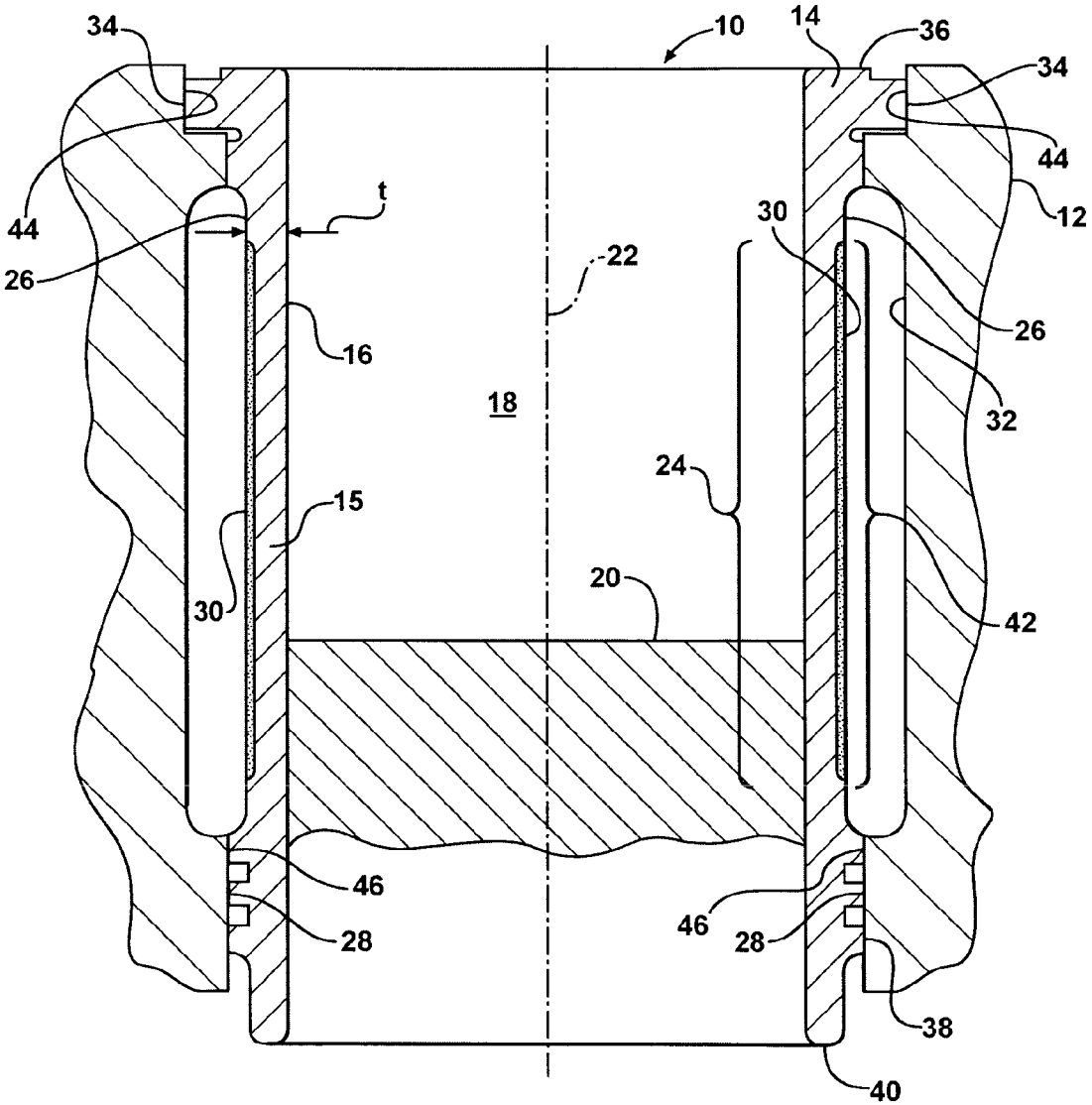
FIG. 1 is a fragmentary cross-sectional view of a cylinder block having a cylinder liner constructed according to one presently preferred embodiment of the invention.

Referring in more detail to the drawings, FIG. 1 illustrates a cylinder liner 10 constructed according to one presently preferred embodiment of the invention disposed in a cylinder block 12 of an internal combustion diesel engine. The cylinder liner 10 has a body 14 with a generally cylindrical wall 15 having and inner surface 16 defining a cylinder bore 18 for reciprocation of a piston 20 along a central axis 22 and against a portion 24 of the inner surface 16. The body 14 has an outer surface 26 with a portion preferably sized for close receipt in a housing 28 of the cylinder block 12. Further, the outer surface 26 has a hardened outer layer 30 arranged to register with a cooling jacket 32 in the cylinder block 12. The cooling jacket 32 contains fluid, such as water, for example, that cools and regulates the temperatures of the cylinder liner 10 and piston 20 in use to minimized the thermal effects thereto, thereby prolonging their life in use. The hardened outer layer 30 further improves the useful life of the cylinder liner 10 by inhibiting erosion from cavitation within the cooling jacket 32. As such, the useful life and performance of the engine is enhanced.

Figure 2:
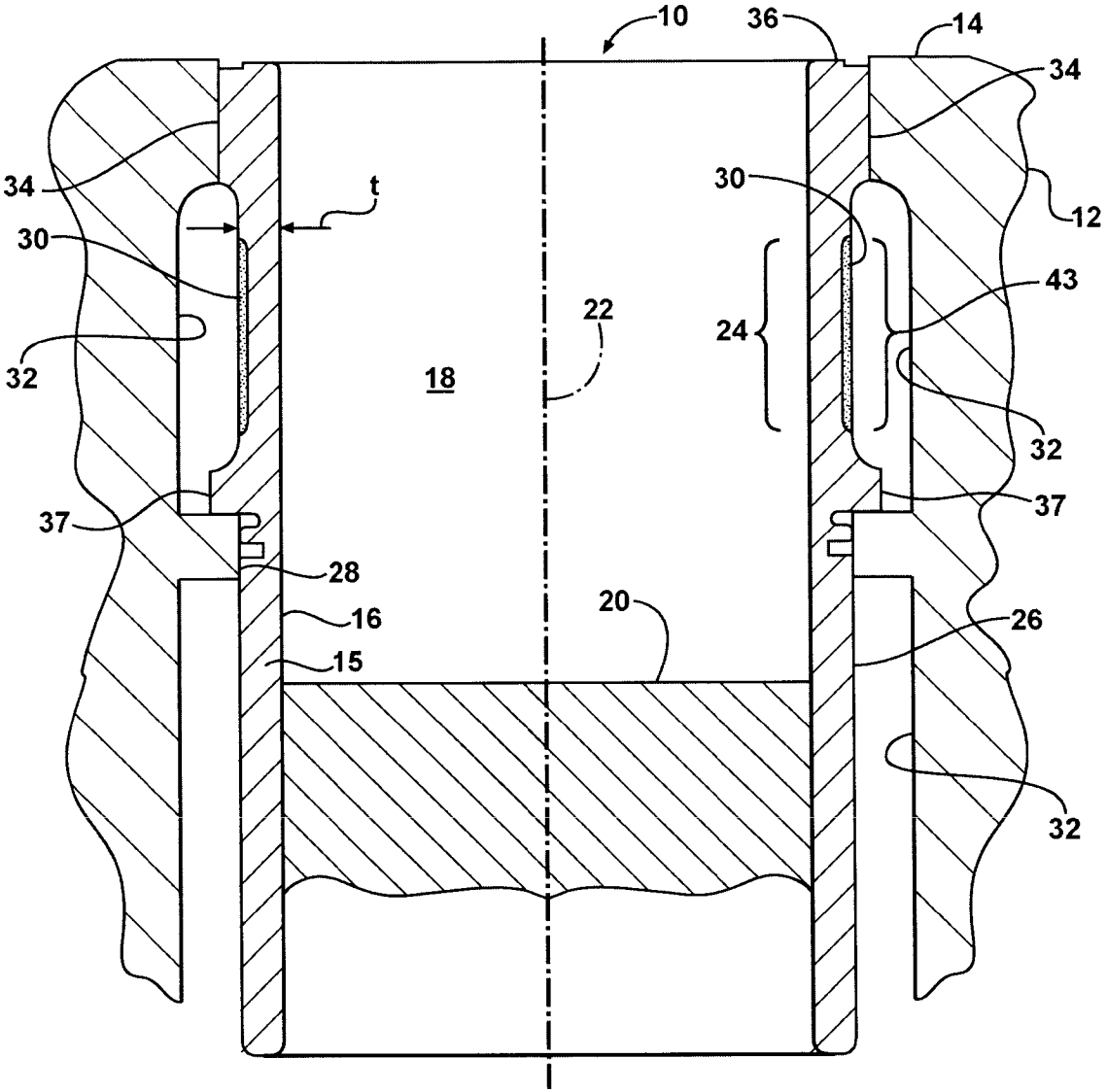
FIG. 2 is a view similar to FIG. 1 with a cylinder liner constructed according to another presently preferred embodiment of the invention.

In FIG. 1, the cylinder liner 10, in one presently preferred embodiment, by way of example and without limitation, is constructed having a so-called "top-stop" configuration, and in FIG. 2, the cylinder liner 10, in another presently preferred embodiment, by way of example and without limitation, is constructed having a so-called "mid-stop" configuration. It should be recognized that the type of configuration is not limiting to the scope of the invention, and that other configurations are considered to be within the scope of the invention, such as a so-called "bottom-stop" configuration (not shown), for example. In FIG. 1, the liner 10 has an upper support flange 34 adjacent an upper end 36 and a lower support flange 38 adjacent a lower end 40. The support flanges 34, 38 extend radially outwardly from a portion 42 of the outer surface 26 for a close fit with respective mounting surfaces 44, 46 of the cylinder block housing 28. The portion 42 is opposite the portion 24 of the inner surface 16 that the piston reciprocates against, and is also the portion of the outer surface 26 received within the cooling jacket 32. As such, the portion 42 is in contact with the water in the cooling jacket 32, and thus, is exposed to any cavitation therein. In FIG. 2, the liner 10 has an upper support flange 34 adjacent its upper end 36 and a mid-support flange 37 located approximately midway along a length of the liner. The support flanges 34, 37 extend radially outwardly from a portion 43 of the outer surface 26 for a close fit with respective mounting surfaces 44, 46 of the cylinder block housing 28. The portion 43 is opposite the portion 24 of the inner surface 16 through which the piston reciprocates, and is also the portion of the outer surface 26 received within the cooling jacket 32. As such, the portion 43 is in contact with the water, and thus, is exposed to any cavitation therein.

To inhibit the cavitation in the cooling jacket 32 from eroding the outer surface 26, the hardened outer layer 30 is formed on a section of the portion 42, 43 most exposed to the potential damaging effects caused by the cavitation, and is shown here, for example, as extending over the entire axial length of the respective portion 42, 43 received within the cooling jacket 32. The hardened outer layer 30 is formed by heat treating the portion 42, 43 sufficiently to form a completely martensitic microstructure to a predetermined depth, and preferably to a depth up to about 10 percent of a thickness (t) of the wall 15 or less, which generally corresponds to about 0.5 to 1.5 mm in depth. The hardened outer layer 30 is formed having a hardness between about 42 to 55 Rc and with a smooth internal stress gradient to inhibit crack formation and crack propagation.

The manufacture of the cylinder liner 10 begins by casting iron to form a rough cast of the cylinder body 14, and then rough machining the necessary surfaces, depending on the application, such as the inner surface 16, outer surface 26, and possibly the primary and secondary mount flanges 34, 38. Then, heat treating the machined portion 42, 43 of the outer surface in an induction heating process to form the martensitic hardened outer layer 30. If desired, the inner surface 16 forming the cylinder bore 18 can also be heat treated. Further, tempering the hardened outer layer 30 to the desired hardness between about 42-52 Rc to the desired depth between about 0.5 to 1.5 mm. Lastly, finish machining the desired critical surfaces requiring close tolerances, such as the primary and secondary flanges 34, 38, the inner surface 16, and any other surfaces engaged with the cylinder block 12.

It is to be understood that other embodiments of the invention which accomplish the same function are incorporated herein within the scope of any ultimately allowed patent claims.

What is claimed is:

1. A cast iron cylinder liner for receipt in an internal combustion engine cylinder block having a water cooling jacket surrounding a portion of the cylinder liner to facilitate regulating the temperature of the cylinder liner, said cylinder liner, comprising:

a cylinder liner wall having an inner surface providing a cylinder bore extending along a central axis for reciprocation of a piston against an axial portion of said inner surface and an outer surface opposite said axial portion, said outer surface having a hardened outer layer of purely martensitic microstructure for direct exposure to the water cooling jacket, wherein said inner surface and said outer surface define a wall thickness of said cylinder liner wall, said hardened outer layer having a hardened depth equal to 10 percent or less of said wall thickness, said hardened depth being greater than zero.

2. The cast iron cylinder liner of claim 1 wherein said hardened depth is between about 0.5 mm and 1.5 mm.

3. The cast iron cylinder liner of claim 1 wherein said hardened outer layer has a hardness between about 42-55 Rc.

4. A method of constructing a cast iron cylinder liner for an internal combustion engine, comprising:

casting an iron cylinder liner body having a cylinder wall with a cylinder bore and an outer surface;

machining an inner surface of the cylinder bore;

machining at least a portion of said outer surface opposite said inner surface; and heat treating said machined portion of said outer surface to provide a purely martensitic hardened layer having a depth equaling 10 percent or less of a thickness of said cylinder wall, said depth being greater than zero.

5. The method of claim 4 wherein said heat treating step includes tempering said hardened layer.

6. The method of claim 5 further including tempering said hardened layer to a hardness between about 42-55 Rc.

7. The method of claim 4 further including performing said heat treating step using an induction heating process.

8. The method of claim 4 further including forming said hardened layer having a depth of between about 0.5 to 1.5 mm.

* * * * *